US007060140B2

(12) United States Patent
Cheng et al.

(10) Patent No.: US 7,060,140 B2
(45) Date of Patent: Jun. 13, 2006

(54) SELF-HEALING TRIBOLOGICAL SURFACES

(75) Inventors: Yang-Tse Cheng, Rochester Hills, MI (US); Wangyang Ni, East Lansing, MI (US); Michael J. Lukitsch, Port Huron, MI (US); Anita M. Weiner, West Bloomfield, MI (US); David S. Grummon, E. Lansing, MI (US)

(73) Assignees: General Motors Corporation, Detroit, MI (US); Michigan State University, East Landing, MI (US)

( * ) Notice: Subject to any disclaimer, the term of this patent is extended or adjusted under 35 U.S.C. 154(b) by 417 days.

(21) Appl. No.: 10/409,645

(22) Filed: Apr. 8, 2003

(65) Prior Publication Data

US 2004/0202888 A1 Oct. 14, 2004

(51) Int. Cl.
*C22F 1/00* (2006.01)
*B29C 51/14* (2006.01)
*B29C 59/00* (2006.01)

(52) U.S. Cl. ..... 148/527; 148/537; 148/563; 264/230; 264/284; 264/293

(58) Field of Classification Search ..... 148/527, 148/537, 563; 264/230, 284, 293
See application file for complete search history.

(56) References Cited

U.S. PATENT DOCUMENTS 4,985,196 A * 1/1991 LeDoux et al. ..... 264/516
4,990,545 A * 2/1991 Hourai et al. ..... 521/171
5,139,832 A * 8/1992 Hayashi et al. ..... 428/35.5
6,084,849 A * 7/2000 Durig et al. ..... 369/126

OTHER PUBLICATIONS

R. Liu and D. Y. Li, Materials Science and Technology, vol. 16, Mar. 2000, Indentation Behaviour and Wear Resistance of Pseudoelastic Ti-Ni Alloy, p. 328-332.
R. Liu and D. Y. Li, Materials Science and Engineering A277 (2000) 169-175, A finite element model study on wear resistance of pseudoelastic TiNi alloy.
J. Singh and A.T. Alpas, Wear "Dry sliding wear mechanisms in a Ti50Ni47Fe3 intermetallic alloy", Wear 181-183 (1995) pp. 302-311.

(Continued)

*Primary Examiner*—George Wyszomierski
(74) *Attorney, Agent, or Firm*—Kathryn A. Marra

(57) ABSTRACT

A self-healing tribological surface comprises a shape memory material. The self-healing tribological surface can be used for recovering a scratches and/or indentations in the surface. Processes for recovering scratches or indentations generally comprises forming a shape memory material onto the surface; scratching or indenting the surface; and heating an area about the scratch or indentation, wherein a depth of the scratch or the indentation decreases after heating as compared to the depth prior to heating.

13 Claims, 7 Drawing Sheets
(1 of 7 Drawing Sheet(s) Filed in Color)

OTHER PUBLICATIONS

R.H. Richman, A.S. Rao, D.E. Hodgson; "Cavitation erosion of two NiTi alloys", Wear 157 (1992) 401-407.
W. J. Buehler, F. E. Wang: "A Summary of Recent Research on the NiTiNOL Alloys and Their Potential Application in Ocean Engineering", Ocean Engng. vol. 1, pp. 105-120.
Wangyang Ni, Yang-Tse Cheng, D. S. Grummon: "Recovery of microindents in a nickel-titanium shape-memory alloy: A "self-healingj" effect", Applied Physics Letters, vol. 80, No. 18, May 6, 2002.
P. Clayton: "Tribological behavior of a titanium-nickle alloy", Wear, 162-164 (1993) 202-210.
H.C. Lin, H.M. Iiao, J. L. He, K.C.Chen, K.M.Lin: "Wear Characteristics of tiNi Shape *memory* Alloys", Metallurgical and Materials Transactions A, vol. 28A, 1871 (1997).
T. Girardeau, K. Bouslykhane, J. Mimault, J.P.Villain, P. Chartier, "Wear improvement and local structure in nickel-titanium coatings produced by reactive ion sputtering"; Thin solid films 283, 67-74 (1996).

* cited by examiner

SELF-HEALING TRIBOLOGICAL SURFACES

BACKGROUND

This disclosure relates to self-healing tribological surfaces and shape memory materials.

Shape memory alloys generally refer to a group of metallic materials that demonstrate the ability to return to some previously defined shape or size when subjected to an appropriate thermal stimulus. Shape memory alloys are capable of undergoing phase transitions in which their flexural modulus, yield strength, and shape orientation are altered as a function of temperature. Generally, in the low temperature, or martensite phase, shape memory alloys can be plastically deformed and upon exposure to some higher temperature will transform to an austenitic phase, or parent phase, returning to their shape prior to the deformation. Materials that exhibit this shape memory effect only upon heating are referred to as having one-way shape memory. Those materials that also exhibit shape memory upon recooling are referred to as having two-way shape memory behavior.

Shape memory alloys typically exist in several different temperature-dependent phases. The most commonly utilized of these phases are the so-called martensite and austenite phases. In the following discussion, the martensite phase generally refers to the more deformable, lower temperature phase whereas the austenite phase generally refers to the more rigid, higher temperature phase. When the shape memory alloy is in the martensite phase and is heated, it begins to change into the austenite phase. The temperature at which this phenomenon starts is often referred to as austenite start temperature ($A_s$). The temperature at which this phenomenon is complete is called the austenite finish temperature ($A_f$). When the shape memory alloy is in the austenite phase and is cooled, it begins to change into the martensite phase, and the temperature at which this phenomenon starts is referred to as the martensite start temperature ($M_s$). The temperature at which martensite finishes transforming to martensite is called the martensite finish temperature ($M_f$). Generally, the shape memory alloys are soft and easily deformable in their martensitic phase and are hard, stiff, and/or rigid in the austenitic phase.

Shape memory alloys can exhibit a one-way shape memory effect, an intrinsic two-way effect, or an extrinsic two-way shape memory effect depending on the alloy composition and processing history. Annealed shape memory alloys typically only exhibit the one-way shape memory effect. Sufficient heating subsequent to low-temperature deformation of the shape memory material will induce the martensite to austenite type transition, and the material will recover the original, annealed shape. Hence, one-way shape memory effects are only observed upon heating.

BRIEF SUMMARY

Disclosed herein is a process for recovering an indent in a surface. The process comprises forming a shape memory material onto the surface; indenting the surface; and heating an area about the indent, wherein a depth of the indent decreases after heating as compared to the depth prior to heating.

A process for recovering a scratch comprises forming a shape memory material onto the surface; scratching the surface; and heating an area about the scratch, wherein a depth of the scratch decreases after heating as compared to the depth prior to heating.

A self-healing tribological surface comprises a shape memory alloy; and a hard coat formed on the shape memory alloy.

The above described and other features are exemplified by the following figures and detailed description.

BRIEF DESCRIPTION OF THE DRAWINGS

The patent application contains at least one drawing executed in color. Copies of this patent application with color drawing(s) will be provided by the Office upon request and payment of the necessary fee. Referring now to the FIGS., which are exemplary embodiments and wherein like elements are numbered alike.

DETAILED DESCRIPTION

Figures 1, 2:
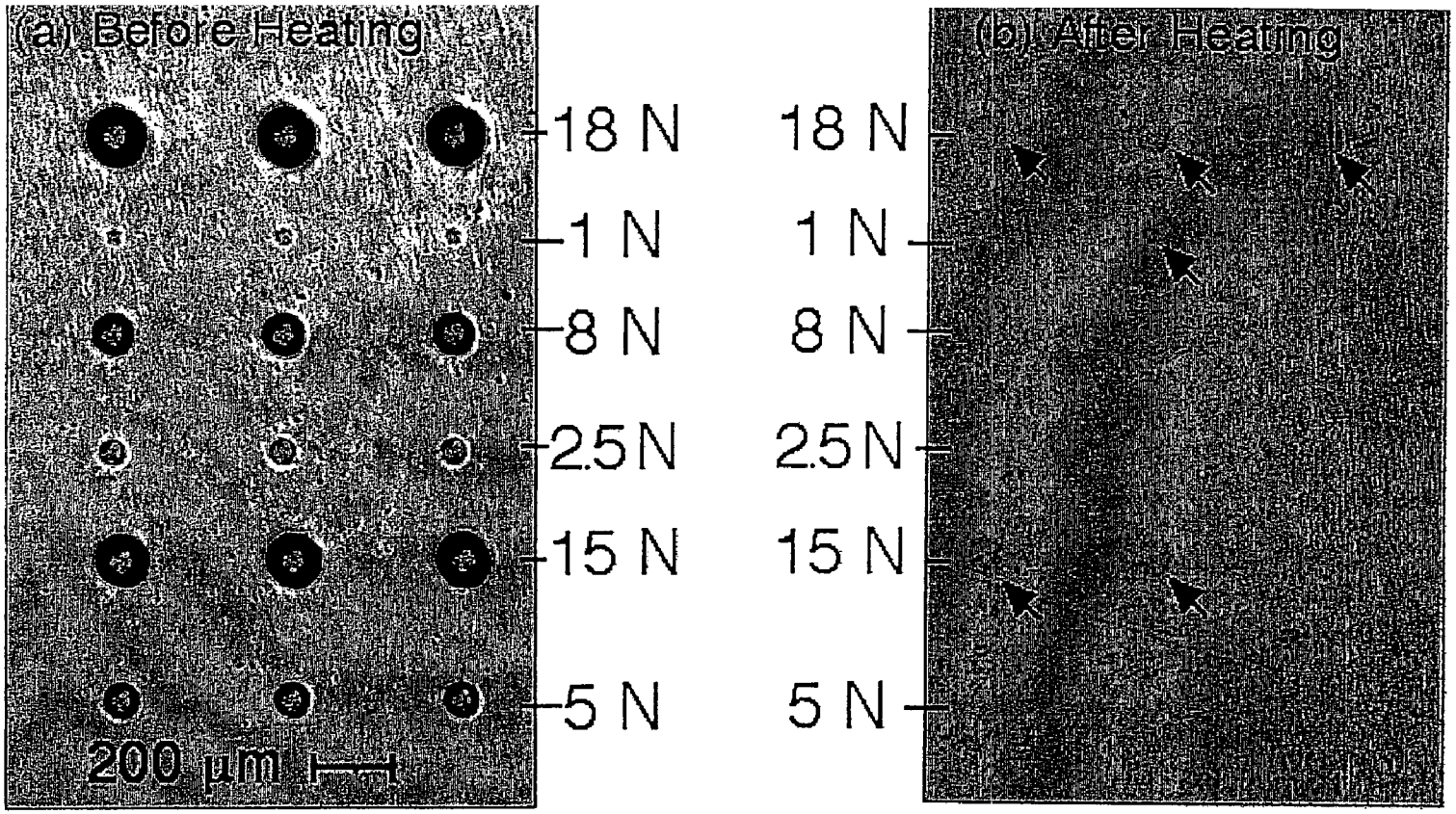
FIGS. 1 and 2 are micrographs of spherical indents made in a martensite titanium nickel alloy before and after heating past the austenite finish temperature.

Surface mediated damage caused by mechanical contact including, but not limited to, fatigue, wear, and/or erosion processes can be recovered or partially recovered by forming a shape memory protective coating onto the surface or by fabricating the surface from a shape memory material. It has been found that the shape memory material provides a self-healing tribological surface, wherein application of heat can be used to recover or partially recover the surface mediated damage to its undamaged surface condition. In this manner, scratches, indentations, and the like, that often occur as a result of mechanical contact including, but not limited to, fatigue, wear, and/or erosion processes can be recovered in terms of appearance, surface roughness, geometry, or like recoverable properties.

The shape memory material can be any shape memory material so long as the shape memory material exhibits a shape memory effect upon heating. Suitable shape memory materials include shape memory alloys, shape memory polymers, and the like. In a preferred embodiment, the shape memory material is a shape memory alloy.

Suitable shape memory alloy materials for forming or for coating the surface include, but are not intended to be limited to, nickel-titanium based alloys (including high temperature modifications such as ti(NiPt), Ti(NiPd), Ti(NiAu), (TiHf)Ni, and the like), indium-titanium based alloys, nickel-aluminum based alloys, nickel-gallium based alloys, copper based alloys (e.g., copper-zinc-aluminum alloys, copper-aluminum-nickel alloys, copper-gold, and copper-tin alloys), gold-cadmium based alloys, silver-cadmium based alloys, indium-cadmium based alloys, manganese-copper based alloys, iron based alloys, (e.g., iron-platinum based alloys, iron-palladium based alloys, iron-manganese alloys, and iron-chromium alloys) and the like. The alloys can be binary, ternary, or any higher order so long as the alloy composition exhibits a shape memory effect, e.g., change in shape orientation, changes in yield strength, and/or flexural modulus properties, damping capacity, and the like. A preferred shape memory alloy is a nickel-titanium based alloy commercially available under the trademark NITINOL from Shape Memory Applications, Inc.

Generally, shape memory polymers are co-polymers comprised of at least two different units which may be described as defining different segments within the co-polymer, each segment contributing differently to the flexural modulus properties and thermal transition temperatures of the material. Segment refers to a block, graft, or sequence of the same or similar monomer or oligomer units which are copolymerized to form a continuous crosslinked interpenetrating network of these segments. These segments may be crystalline or amorphous materials and therefore may be generally classified as a hard segment(s) or a soft segment(s), wherein the hard segment generally has a higher glass transition temperature (Tg) or melting point than the soft segment. Each segment then contributes to the overall recovery properties of the shape memory polymer (SMP) and the thermal transitions thereof, the hard segments tending to increase and the soft segments tending to decrease both the recovery properties and the temperatures associated with their changes. When multiple segments are used, multiple thermal transition temperatures may be observed, wherein the thermal transiton temperatures of the copolymer may be approximated as weighted averages of the thermal transiton temperatures of its comprising segments. The previously defined or permanent shape of an SMP can be set by melting or processing the polymer at a temperature higher than the highest thermal transition temperature for the shape memory polymer or its melting point, followed by cooling below that thermal transition temperature. A temporary shape can be set by heating the material to a temperature higher than any Tg or thermal transition temperature of the shape memory polymer, but lower than the highest Tg or its melting point. The temporary shape is set by applying an external stress while processing the material above the Tg, but below the highest thermal transition temperature or melting point of the shape memory material followed by cooling to fix the shape. The material can then be reverted to the permanent shape by heating the material above its Tg but below the highest thermal transition temperature or melting point. Thus, by combining multiple soft segments it is possible to demonstrate multiple temporary shapes and with multiple hard segments it may be possible to demonstrate multiple permanent shapes. Similarly using a layered or composite approach, a combination of multiple SMPs will demonstrate transitions between multiple temporary and permanent shapes.

Shape memory polymers may contain more than two transition temperatures. For example, the SMP composition may comprise a composite of two or more different shape memory polymers, each with different Tg's resulting in a material with two or more transition temperatures: the lowest transition temperature representing the first transition temperature, and a distinct transition temperature for each constituent SMP. The presence of multiple SMPs in a composite SMP material allows for the definition of multiple temporary and permanent shapes and permits the SMP composition to exhibit multiple transitions between temporary and permanent shapes.

Suitable shape memory polymers include, but are not intended to be limited to, thermoplastics, interpenetrating networks, semi-interpenetrating networks, or mixed networks. The polymers can be a single polymer or a blend of polymers. The polymers can be linear or branched thermoplastic elastomers with side chains or dendritic structural elements. Suitable polymer components to form a shape memory polymer include, but are not limited to, polyphosphazenes, poly(vinyl alcohols), polyamides, polyester amides, poly(amino acid)s, polyanhydrides, polycarbonates, polyacrylates, polyalkylenes, polyacrylamides, polyalkylene glycols, polyalkylene oxides, polyalkylene terephthalates, polyortho esters, polyvinyl ethers, polyvinyl esters, polyvinyl halides, polyesters, polylactides, polyglycolides, polysiloxanes, polyurethanes, polyethers, polyether amides, polyether esters, and copolymers thereof. Examples of suitable polyacrylates include poly(methyl methacrylate), poly (ethyl methacrylate), poly(butyl methacrylate), poly(isobutyl methacrylate), poly(hexyl methacrylate), poly(isodecyl methacrylate), poly(lauryl methacrylate), poly(phenyl methacrylate), poly(methyl acrylate), poly(isopropyl acrylate), poly(isobutyl acrylate) and poly(octadecyl acrylate). Examples of other suitable polymers include polystyrene, polypropylene, polyvinyl phenol, polyvinylpyrrolidone, chlorinated polybutylene, poly(octadecyl vinyl ether), ethylene vinyl acetate, polyethylene, poly(ethylene oxide)-poly (ethylene terephthalate), polyethylene/nylon (graft copolymer), polycaprolactones-polyamide (block copolymer), poly (caprolactone)dimethacrylate-n-butyl acrylate, poly (norbornyl-polyhedral oligomeric silsequioxane), polyvinylchloride, urethane/butadiene copolymers, polyurethane block copolymers, styrene-butadiene-styrene block copolymers, and the like.

The shape memory material may be recovered by any suitable means, preferably a means for subjecting the material to a temperature change above a transformation temperature. For example, heat may be supplied using hot gas (e.g. air), steam, or an electrical current. The recovery means may, for example, be from the environment, in the form of a heated room or enclosure, an iron for supplying heat, a hot air blower or jet, means for passing an electric current through, or inducing an electrical current in (e.g. by magnetic or microwave interaction), the shape memory material (or through or in an element in thermal contact therewith).

The temperature needed for recovery can be set at any temperature. Engineering the composition and structure of the alloy (or polymer) itself can allow for the choice of a particular temperature for a desired application. A preferred temperature for recovery is greater than or equal to about 50° C. to about 100° C. above the ambient or operating temperature. The temperature required for recovery may be supplied from an external source or may be generated internally such as from the environment or as a result of frictional wear.

For coatings, the thickness of the shape memory material formed on the surface is preferably greater than or about an expected indentaton or scratch penentration depth produced by mechanical contact including, but not limited to, the fatigue, wear, and/or erosion processes. The support on which the coating is formed can be any suitable support. Forming the shape memory alloy coating may include chemical vapor deposition, physical vapor deposition, thermal spraying, plasma spraying, and the like. Forming the shape memory polymer includes solvent coating, and the like. Alternatively, a sheet of the shape memory alloy may be affixed by explosive bonding, brazing, cladding, or like processes or a polymer may be secured to a support/article by means of an adhesive such as cyanoacrylates, epoxies, or the like.

In another embodiment, a hard coat is formed on the shape memory material. The hard coat can be used to further minimize surface mediated damage. In addition, the hard coat provides greater protection against plowing defects as a result of scratches in the shape memory material. Plowing defects result in a build-up of material along the ridges of the scratch as well as at the ending point of the scratch. Material that is built up in this manner cannot be recovered by a thermal treatment. The presence of the hard coat prevents or significantly reduces the pile up of material caused by plowing.

The hard coat also provides a load bearing capacity, which can reduce the penetration depth of the scratch. Relatively deep scratches into the shape memory alloy surface cannot be fully recovered. With regard to shape memory alloy materials, deep scratches are those scratches that have a scratch depth that exceeds the maximum recoverable strain inherent for the particular shape memory alloy material. For example, nickel titanium alloys generally have a maximum recoverable strain of about 8 to 10 percent depending on the alloy composition, which translates to a maximum depth recovery of about 3 to about 4 microns when the spherical indenter is about 200 microns. Depending on the radius of the indenter, greater depth recovery can be obtained. More generally, the complete recoverable depth is expected to be less than 10 percent of the diameter of a spherical shaped asperity. Of course, maximum depth recovery may vary if the surface mediated damage is in the form of an arbitrarily shaped scratch since strain distribution surrounding the scratch is relatively complex compared to spherical indents. Thus, the hard coat provides a load carrying ability and thus reduces the overall strain to the underlying shape memory alloy material.

If present, the hard coat preferably has a thickness effective to reduce the strain and minimize the surface mediated damage to the underlying shape memory material. In a preferred embodiment, the hard coat has a thickness of about 0.1 microns to about 300 microns, with a thickness of about 1 micron to about 100 microns more preferred, and with a thickness of about 2 microns to about 5 microns even more preferred. For some hard coat materials, the maximum thickness will be determined by the manner in which it is deposited.

Exemplary hard coat materials for use with shape memory alloys include diamond-like carbon, nitrides, carbides, oxides, borides, and like materials. The hard coat material may be formed on the shape memory alloy by physical vapor deposition, chemical vapor deposition, electroplating, thermal spraying, plasma spraying, and the like. The particular hard coat material should be chosen to be stable and inert to the temperatures employed for recovery as well as provide effective adhesion to the shape memory alloy surface.

Exemplary hard coat materials for use with shape memory polymers include fluoropolymers, electroless nickel, physical vapor deposited metals, diamond like carbons, ceramics, and their composites. The particular hard coat material should be chosen to be stable and inert to the temperatures employed for recovery as well as provide effective adhesion to the shape memory polymer surface.

Optionally an adhesion promoting layer can be used between the hard coat and the shape memory material. Suitable adhesion promoters for use with shape memory alloys include deposition of metals such as chromium, titanium, silicon, and the like as well as alloys thereof.

The disclosure is further illustrated by the following non-limiting examples.

EXAMPLE 1

In this example, a commercial wrought nickel titanium shape memory alloy under the trade mark NITINOL was obtained from Shape Memory Applications, Inc. in the form of a 0.75 mm thick flat annealed sheet. The nominal alloy composition was 50.8 atom percent (at. %) nickel, balance titanium with oxygen and carbon levels below 0.05 wt. %. The characteristic transformation temperatures were measured using a Mettler Toledo DSC821e differential scanning calorimeter (DSC) at heating and cooling rates of 10° C. per minute. X-ray diffraction (XRD) measurements were carried out on a Siemens D500 diffractometer using Cu K $\alpha$ radiation.

Specimens were mechanically polished and finished with 0.25 micron diamond paste to give an average surface roughness of less than 100 nanometers. Indents were made using a CSEM microscratch tester with indentation capability. Two types of diamond indenters, spherical and pyramidal, were used. Vickers (pyramidal) indents were made at loads between 50 and 2500 mN giving indents depths ranging from about 1 to 6 microns. Spherical indents were made with a conical diamond with a 213.4 micron tip radius at loads ranging from 1 to 25N, which produced indents 0.5 to 8 microns deep. The surfaces were then heated in air to a temperature of 150° C. for 10 minutes to bring about a complete martensite to austenite transformation.

FIGS. 1 and 2 show optical micrograph images of the spherical indents at loads from 1 to 25 N before and after the heat treatment. FIG. 1 shows the indents prior to heating whereas FIG. 2 shows the nearly complete disappearance of these indentations following the heat treatment.

Figure 3:
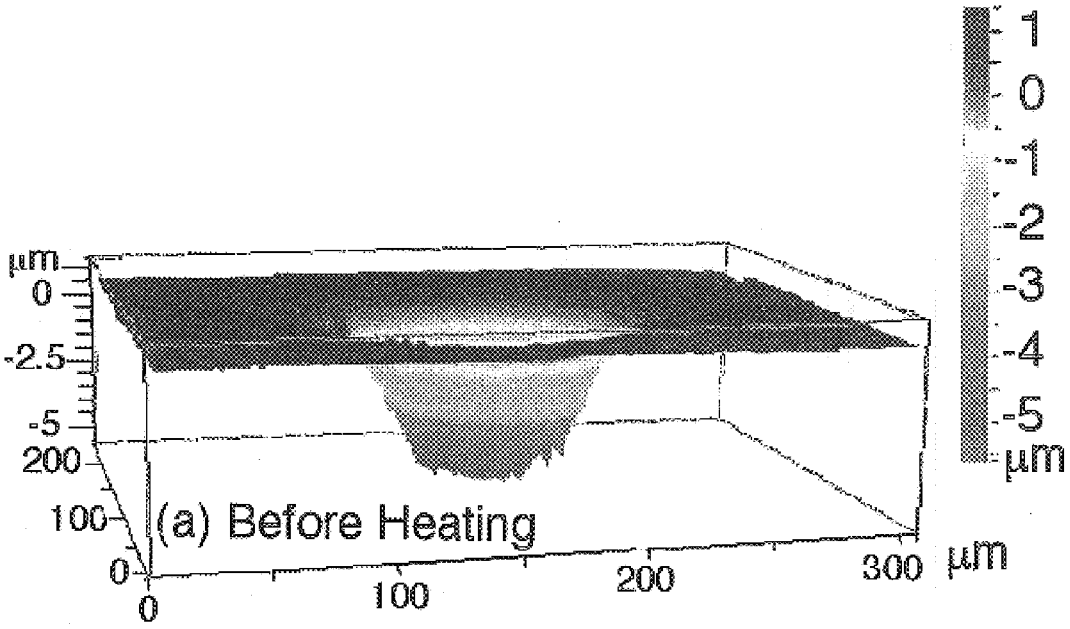
FIGS. 3 and 4 graphically illustrate three-dimensional profiles in a martensite titanium nickel alloy of a spherical indent at a load of 15 N before and after heating past the austenite finish temperature.
Figure 4:
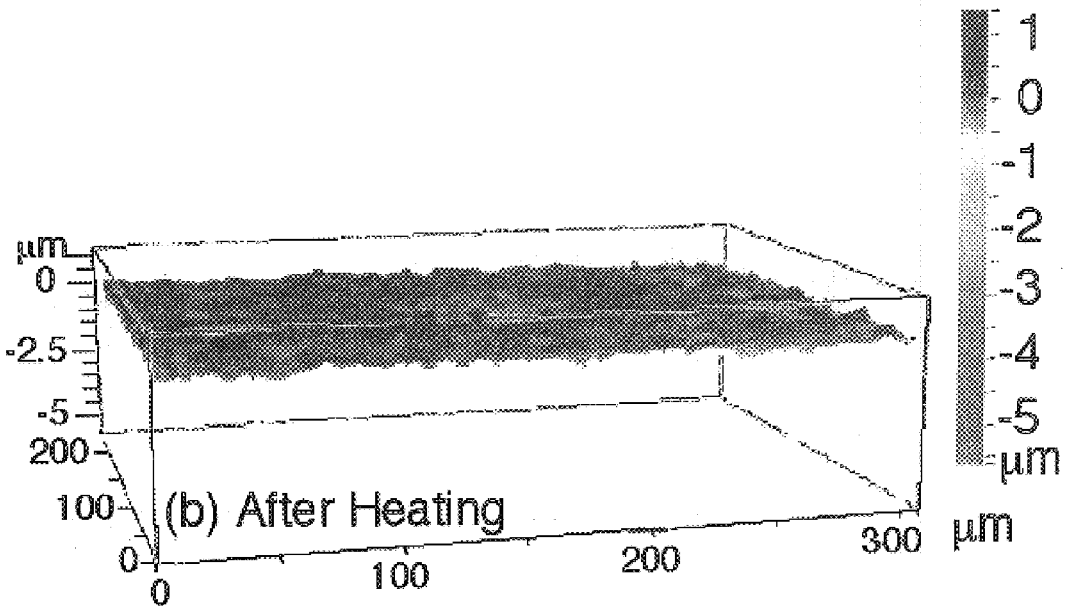

FIGS. 3 and 4 graphically illustrate three-dimensional surface profiles of the spherical indent at a load of 15 N before and after heating past the austenite finish temperature. The three dimensional profiles were generated using a Wyco RST-Plus optical profilometer. The indent profile is about completely removed after the heat treatment.

Figure 5:
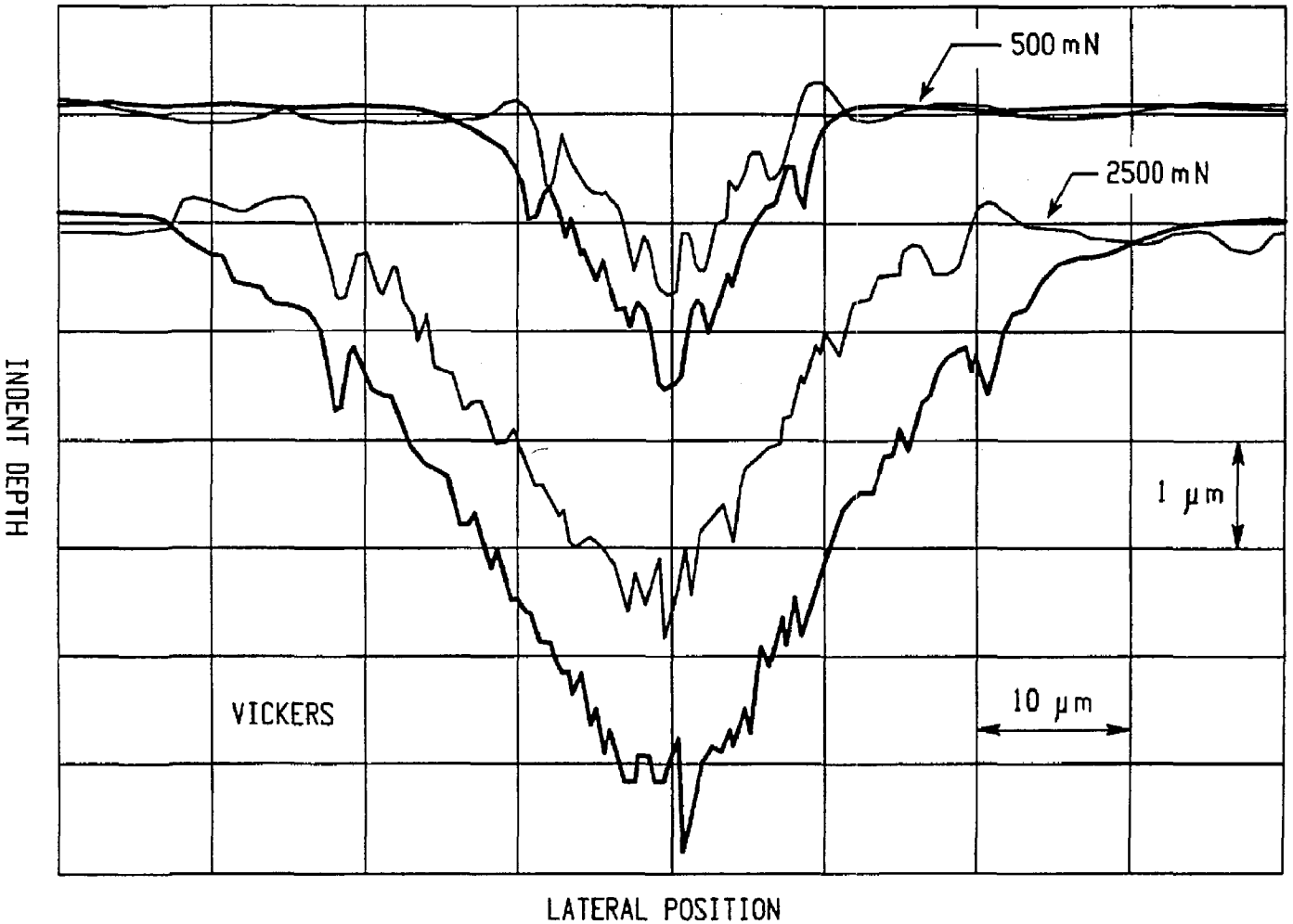
FIG. 5 graphically illustrates cross sectional of profiles of Vickers indents in a martensite titanium nickel alloy before and after heating past the austenite finish temperature.

FIG. 5 graphically illustrates cross sectional of profiles of the Vickers (pyramidal) indents before and after heating past the austenite finish temperature. Partial recovery is observed after heating.

Figure 6:
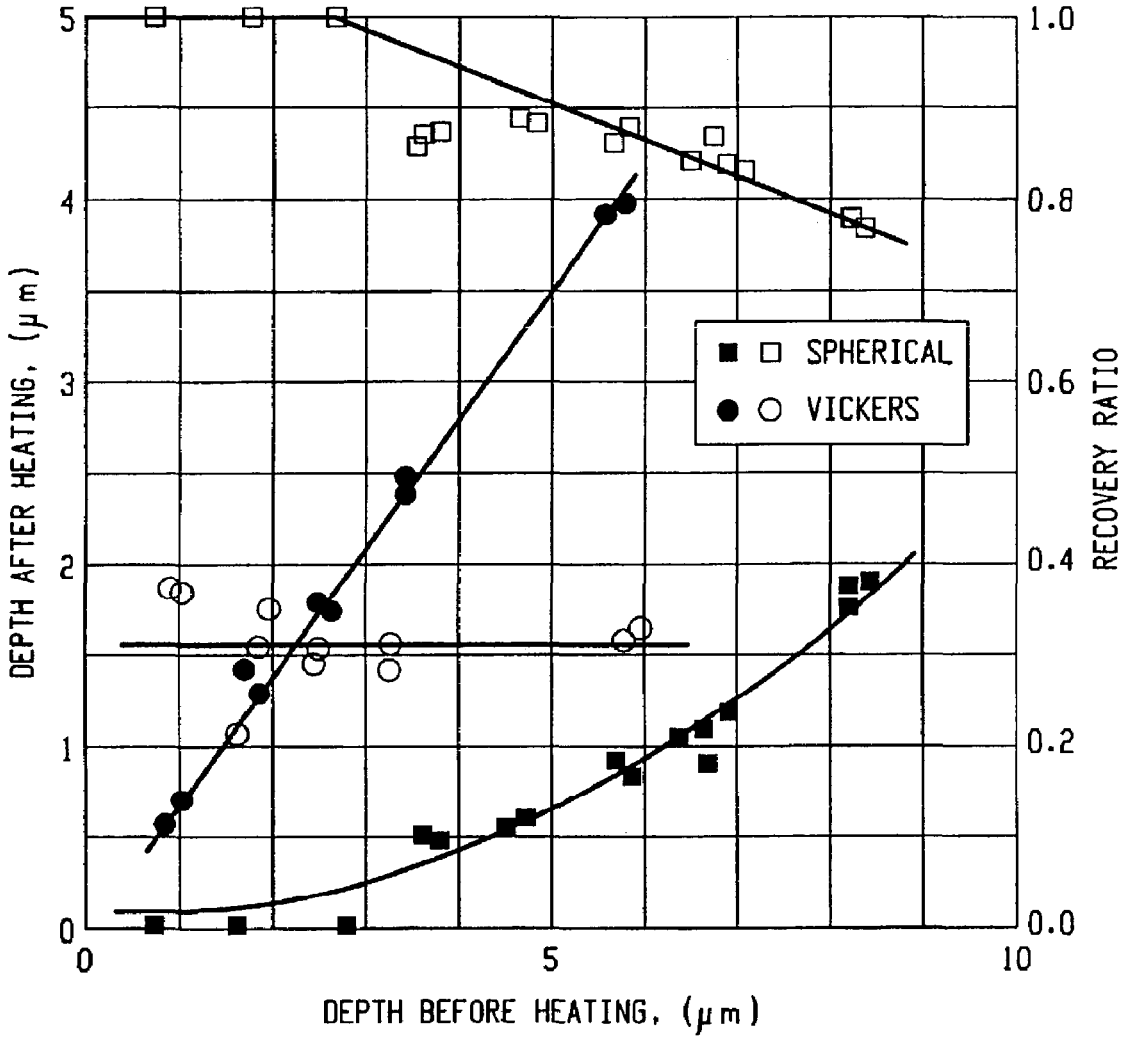
FIG. 6 graphically illustrates a recovery ratio and residual depth after heating as a function of indentation depth for spherical indents and Vickers indents.

The degree of indent recovery was determined quantitatively from the surface profiles by defining a recovery ratio, δ, as shown in equation (1), $$\delta = \frac{d_{\max}^{BH} - d_{\max}^{AH}}{d_{\max}^{BH}} \tag{1}$$

where $d_{max}$ is the maximum residual indent depth after removal of the load and the superscripts BH and AH refer to before and after heating, respectively. The indent recovery rations for indents made at various loads are shown for both indent types in FIG. 6. The recovery of the spherical indent at low loads is almost complete, although noise in the form of surface roughness makes quantification of recovery ratios (δ) near 1.0 problematic. The recovery ratio is close to 0.90 for a 10 N load, and is still quite substantial at the highest load (25N). For Vickers (pyramidal) indents, the recovery of impressions was incomplete and a substantial fraction of the indent impression depth persisted following heating. The recovery ratio (δ) is about 0.30 and appeared to be load dependent for loads between 50 and 2500 mN.

While not wanting to be bound by theory, the recovery behavior of indents may be rationalized using the concept of representative strain. For spherical indentation in elastic-plastic solids, the strain produced in a representative region under an indenter is proportional to the ratio of the contact radius "a" and the indenter radius "R", i.e., $\epsilon_r$=0.2 a/R. Because the contact radius "a" increases with an increase in indentation loads, so does representative strain. Table 1 summarizes the representative strain values calculated using this relationship for spherical indents created by the diamond indenter with R=213.4 microns, in which "a" was measured as half the diameter of the circular impression.

TABLE 1

| Indentation load (N) | 1.0 | 2.5 | 5.0 | 10 | 15 | 20 | 25 |
|---|---|---|---|---|---|---|---|
| Contact radius, "a" (microns) | 20.5 | 31.3 | 39.0 | 59.0 | 68.4 | 73.5 | 82.3 |
| Representative strain, $\epsilon_r$ | 0.019 | 0.0294 | 0.0365 | 0.055 | 0.064 | 0.069 | 0.077 |
| Recovery ratio | ~1.0 | ~1.0 | ~1.0 | 0.872 | 0.849 | 0.838 | 0.770 |

It should be noted that the maximum value of cr (0.077) approaches or exceeds the maximum strain that can be fully reversed by the shape memory effect in nickel titanium alloys. Furthermore, since $\epsilon_r$ can only correspond to a spatially averaged strain, the local maximum strain beneath the indent will certainly exceed this value. Plastic strain in the martensite beyond the level that can be produced by deformation twinning must be accommodated by dislocation production and concomitant strain hardening, which inhibits subsequent strain recovery via shape memory. This may account for residual, irreversible indent displacement, and is consistent with the observation that the degree of indent recovery decreases with an increase in the values of a/R or $\epsilon_r$ for spherical indents.

For sharp pyramidal or conical indenters, the representative strain is determined by the face angles and, since no length scale is involved, the representative strain is independent of the indentation load. This is consistent with the observation that the recovery ratio is approximately independent of load for Vickers geometry. For Vickers indentation in elastic-plastic solids then representative strain is approximately 0.08. Although this representative strain is not appreciably larger than that made by the spherical indenter, it is clear from FIGS. 2 and 3 that Vickers indents recover only about one third as much as spherical indents.

The large observed difference in recovery behavior between spherical and pyramidal indentations may be connected to the magnitude and spatial distribution of the maximum strain associated with the different geometry of the two indenters. The stress at the tip of a perfectly sharp pyramidal or conical indenter rises to a theoretically infinite value at the apex unless plastic deformation occurs. Consequently, the strain in this region could well be in excess of the representative strain. It may thus be that a sufficiently large volume of material directly below the pyramidal indenter was so highly strained that significant deformation occurred by dislocation motion rather than by twinning mechanisms. This volume would not only fail to recover, but could also inhibit shape recovery strain in the underlying material.

In contrast, the maximum stress under the spherical indenter remains finite. It would appear that the strain caused by the stress distribution under the spherical indenter was largely accommodated by twinning mechanisms in the martensite, leading to shape recovery upon heating.

EXAMPLE 2

In this example, the nickel titanium shape memory alloy sheet of Example 1 was subjected to scratch testing. Scratches were made using the CSEM microscratch tester with the conical diamond with a 213.4 micron tip radius at loads of 10 and 25N. Surface profiles of the scratches were measured before and after heat treatment. Heat treatment consisted of heating the surface to a temperature of 150° C. for 5 minutes. Surface profiles were measured after the surface cooled to room temperature.

Figure 7:
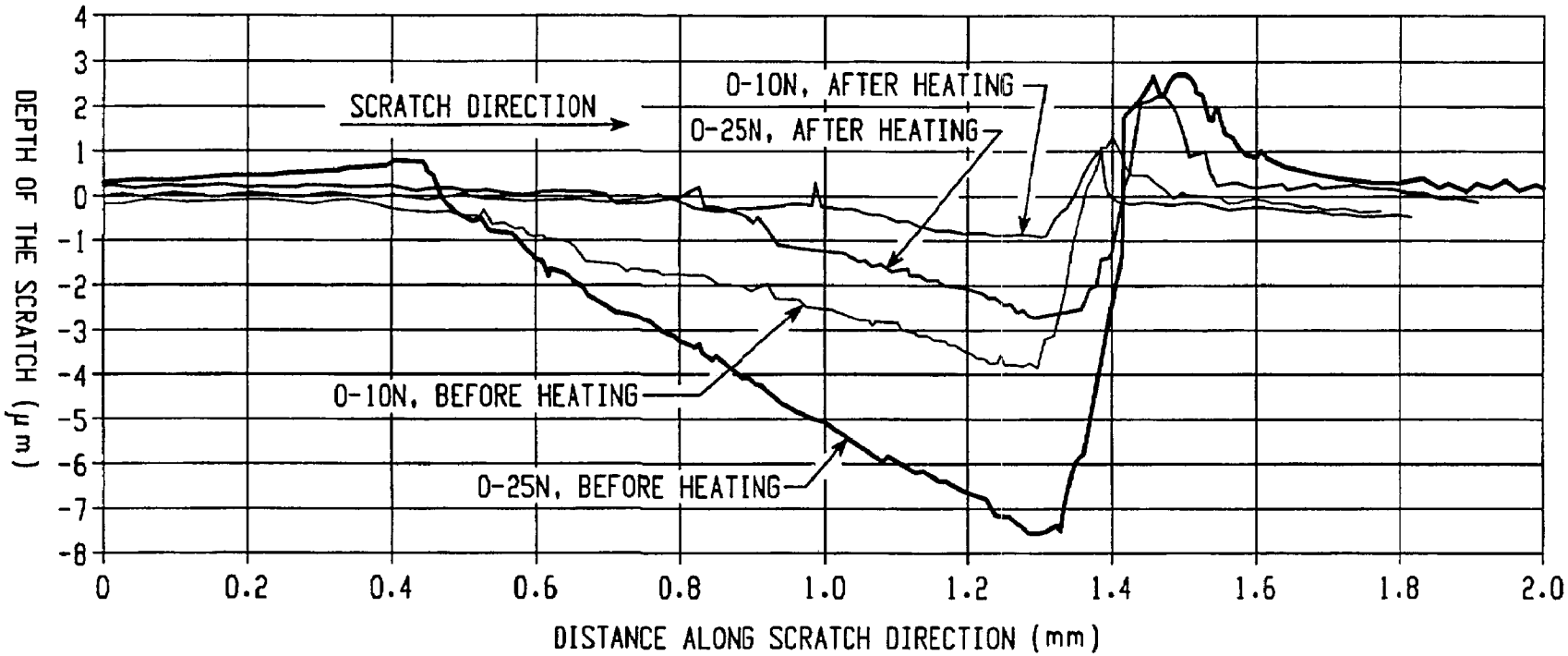
FIG. 7 graphically illustrates cross sectional profiles of scratches in a martensite titanium nickel alloy before and after heating past the austenite finish temperature.

FIG. 7 graphically illustrates cross sectional profiles of scratches before and after heating past the austenite finish temperature. Shallow scratches of about 4 microns as demonstrated by the 10 N loading are about completely recovered. Deeper scratches of about 8 microns as produced by the 25 N loading were partially recovered. While not wanting to be bound by theory, it is believed that the strain experienced by the shape memory alloy during deformation is primarily a function of the contact geometry (i.e., shape and size of asperities) and the contact load (i.e., the normal and tangential loads). Moreover, when the strain is smaller than the maximum recoverable strain as defined by the shape memory alloy material (e.g., about 8% for NiTi alloys), nearly complete recovery of the surface mediated damage (e.g., indents and scratches) can be expected. In contrast, when the strain is greater than the maximum recoverable strain, partial recovery is expected.

It is further observed from the surface profiles as shown in FIG. 7 that plowing of materials by asperities cannot be recovered by thermal treatment. This is evident in the graph from the increase in the depth of the scratch above zero at a distance along the scratch direction of about 1.4 to 1.6 millimeters. Heating did not ameliorate the severity of the buildup in shape memory material.

EXAMPLE 3

In this example, a hard coat was applied to a shape memory sheet material of Example 2. Chromium nitride was deposited at a thickness of about 540 nanometers onto the titanium shape memory alloy surface. Scratches were made with a conical diamond with a 213.4 micron tip radius as in Example 2. After the scratches were made, the sheet material was heated to 150° C. for a period of 5 minutes.

Figure 8A:
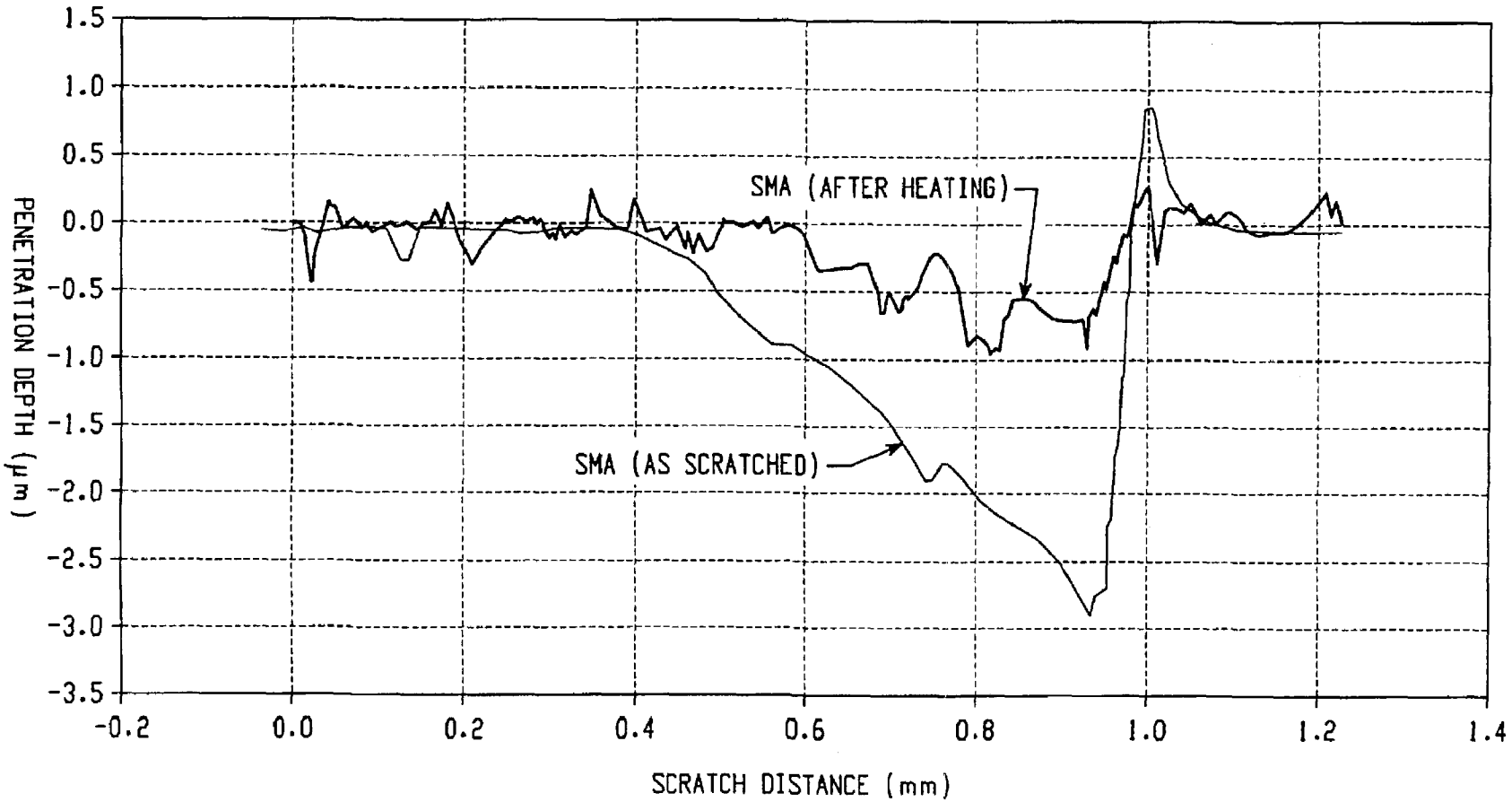
FIGS. 8A and 8B graphically illustrate cross sectional profiles of scratches in a martensite titanium nickel alloy and hard coat composition before and after heating past the austenite finish temperature of the titanium nickel alloy.
Figure 8B:
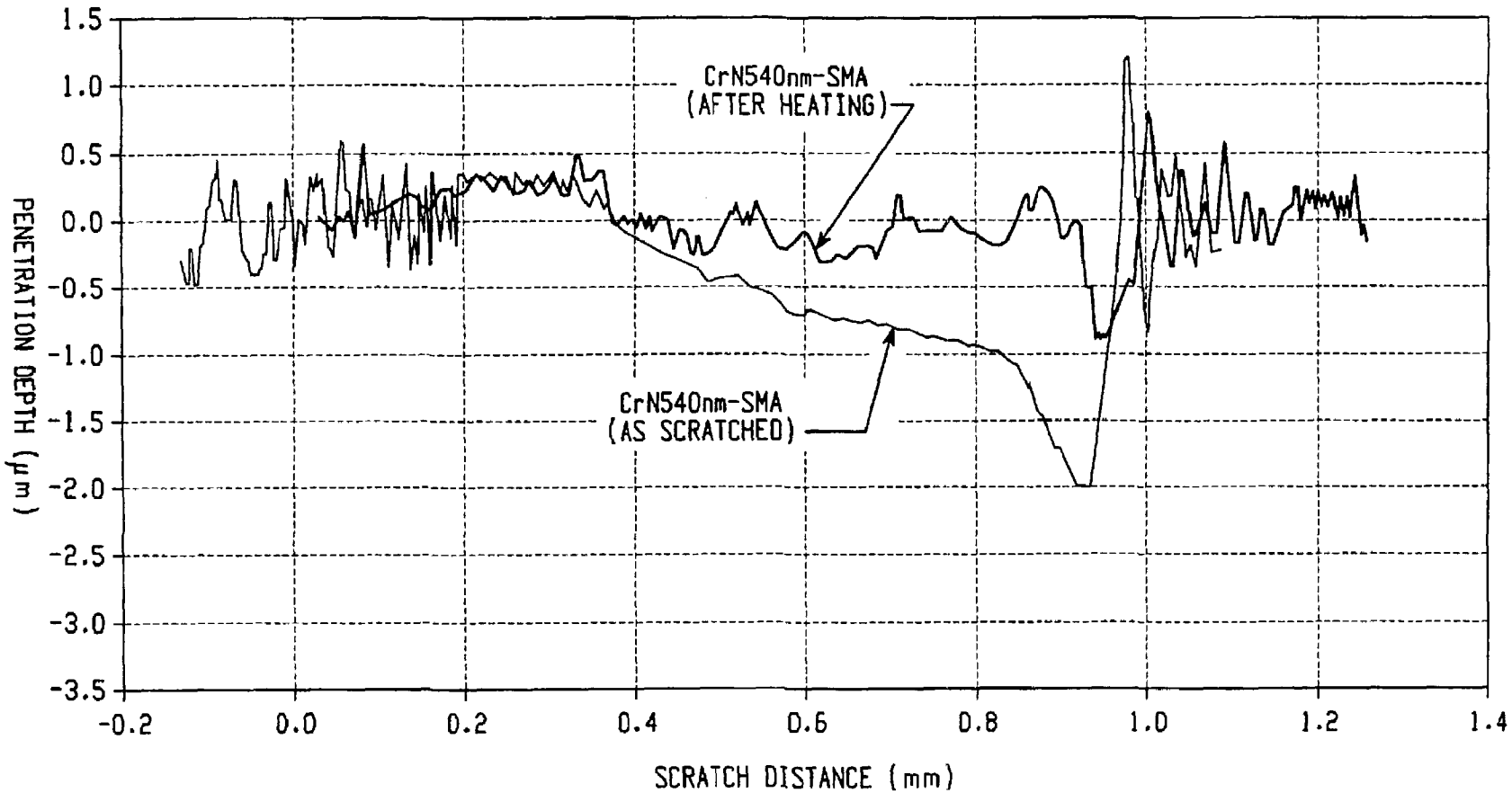

FIGS. 8A and 8B graphically illustrate cross sectional profiles of scratches in nickel titanium alloy and hard coat composition before and after heating past the austenite finish temperature of the titanium nickel alloy. The graphs also show scratch behavior for the same nickel titanium alloys without the hard coat tested under the same conditions.

The results clearly show a significant decrease in penetration depth for nickel titanium alloy coating having the hard coat. Moreover, after heating, the hard coat did not interfere with the recoverability of the scratched surface. Complete recovery was observed. In contrast, the nickel titanium alloy surface without the hard coat did not recover completely.

It will be appreciated that any number of different products or structural elements can be coated with the shape memory material to provide recovery for surface mediated damage. However, it is helpful to know the transition temperature(s) of the shape memory material(s) within the products, to enable the material to be "recovered".

Advantageously, the self-healing tribological surfaces can be used to protect surfaces from indentation and scratches that are frequently encountered in various tribological applications, including but not limited to, wear situations in automobile engines and transmissions. When indentations or scratches are created on these surfaces, a simple thermal treatment, such as thermal annealing or the naturally occurring high temperature environment can be used to reduce or eliminate the magnitude of the scratch or indentation.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A process for recovering an indent, the process comprising:

forming a shape memory material layer onto a support surface;

forming a hard coat onto the shape memory material layer;

indenting the hard coat and the shape memory material layer to form an indent; and heating an area about the indent, wherein a penetration depth of the indent decreases after heating as compared to the penetration depth prior to heating.

2. The process according to claim 1, wherein the shape memory material comprises a shape memory polymer or a shape memory alloy.

3. The process according to claim 2, wherein the shape memory polymer comprises polyphosphazenes, polyvinyl alcohols, polymides, polyester amides, polyamino acids, polyanhydrides, polycarbonates, polyacrylates, polyalkylenes polyacrylamides, polyalkylene glycols, polyalkylene oxides, polyalkylene terephthalates, polyortho esters, polyvinyl ethers, polyvinyl esters, polyvinyl halides, polyesters, polylactides, polyglcolides, polysiloxanes, polyurethanes, polyethers, polyether amides, polyether esters, polyacrylates, polystyrene, polypropylene, polyvinyl phenol, polyvinylpyrrolidone, chlorinated polybutylene, poly(octadecyl vinyl ether), ethylene vinyl acetate, polyethylene, poly(ethylene oxide)-poly(ethylene terephthalate), polyethylene/nylon (graft copolymer), polycaprolactones-polyamide (block copolymer), poly(caprolactone) dimethacrylate-n-butyl acrylate, poly(norbomyl-polyhedral oligomeric silsequioxane), polyvinylchloride, urethane/butadiene copolymers, polyurethane block copolymers, stryene-butadiene-styrene block copolymers, or combinations comprising at least one of the foregoing shape memory polymers.

4. The process according to claim 2, wherein the shape memory alloy comprises nickel-titanium based alloys, indium-titanium based alloys, nickel-aluminum based alloys, nickel-gallium based alloys, copper based alloys, gold-cadmium based alloys, silver-cadmium based alloys, indium-cadmium based alloys, manganese-copper based alloys, or iron based alloys.

5. The process according to claim 2, wherein the shape memory alloy comprises a binary, ternary, or higher order alloy composition.

6. The process according to claim 4, wherein the nickel-titanium based alloys comprise Ti(NiPt), Ti(NiPd), Ti(NiAu), or Ti(HfNi).

7. The process according to claim 1, wherein heating the area about the indent comprises heating to a temperature of about 50° to about 100° C. above an ambient or an operating temperature.

8. A process for recovering a scratch comprising:

forming a shape memory material layer onto a support surface;

forming a hard coat onto the shape memory material layer;

scratching the hard coat and the shape memory material layer to form a scratch on the hard coat and the shape memory material layer; and heating an area about the scratch, wherein a depth of the scratch decreases after heating as compared to the depth prior to heating.

9. The process according to claim 8, wherein the shape memory material comprises a shape memory polymner or shape memory alloy.

10. The process according to claim 9, wherein the shape memory polymer comprises polyphosphazenes, polyvinyl alcohols, polyamides, polyester amides, polyamino acids, polyanhydrides, polycarbonates, polycrylates, polyalkylenes, polyacrylamides, polyalkene glycols, polyalkylene oxides, polyalkylene terephthalates, polyortho esters, polyvinyl ethers, polyvinyl esters, polyvinyl halides, polyesters, polylactides, polyglycolides, polysiloxanes, polypropylene, polyvinyl phenol, polyvinylpyrrolidone, chlorinated polybutylene, poly(octadecyl vinyl ether), ethylene vinyl acctate, polyethylene, poly(ethylene oxide)-poly(ethylene terephthalate), polyethylene/nylon (graft copolymer), polycaprolactones-polyamide (block copolymer), poly(caprolactone) dimethacrylate-n-butyl acrylate, poly(norbornyl-polyhedral oligomeric silsequioxane), polyvinylchloride, urethane/butadiene copolymers, polyurethane block copolymers, styrene-butadiene-styrene block copolymers, or combinations comprising at least one of the foregoing shape memory polymers.

11. The process according to claim 9, wherein the shape memory alloy comprises nickel-titanium based alloys, indium-titanium based alloys, nickel-aluminum based alloys, nickel-gallium based alloys, copper based alloys, gold-cadmium based alloys, silver-cadmium based alloys, indium-cadmium based alloys, manganese-copper based alloys, or iron based alloys.

12. The process according to claim 11, wherein the nickel-titanium based alloys comprise Ti(NiPt), Ti(NiPd), Ti(NiAu), or Ti(HfNi).

13. The process according to claim 9, wherein the shape memory alloy comprises a binary, ternary, or higher order alloy composition.

* * * * *